US007800058B2

(12) United States Patent
Sugiyama et al.

(10) Patent No.: US 7,800,058 B2
(45) **Date of Patent: *Sep. 21, 2010**

(54) MASS SPECTROMETER AND MASS SPECTROMETRY METHOD

(75) Inventors: Masuyuki Sugiyama, Hachioji (JP); Yuichiro Hashimoto, Tachikawa (JP); Hideki Hasegawa, Tachikawa (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 199 days.

This patent is subject to a terminal disclaimer.

(21) Appl. No.: 11/979,811

(22) Filed: Nov. 8, 2007

(65) Prior Publication Data

US 2008/0121795 A1 May 29, 2008

(30) Foreign Application Priority Data

Nov. 24, 2006 (JP) ..... 2006-316462

(51) Int. Cl.
*H01J 49/00* (2006.01)

(52) U.S. Cl. ..... 250/292; 250/281; 250/282; 250/290

(58) Field of Classification Search ..... 250/281, 250/282, 290, 292
See application file for complete search history.

(56) References Cited

U.S. PATENT DOCUMENTS 2,950,389 A 8/1960 Paul et al.
5,420,425 A 5/1995 Bier et al.
5,783,824 A 7/1998 Baba et al.
6,177,668 B1 1/2001 Hager
7,592,589 B2 * 9/2009 Hashimoto et al. ..... 250/292

OTHER PUBLICATIONS

Hager, James W., "A new linear ion trap mass spectrometer", Rapid Communications in Mass Spectrometry, 2002, vol. 16, pp. 512-526.

* cited by examiner

*Primary Examiner*—Jack I Berman
*Assistant Examiner*—Hanway Chang
(74) *Attorney, Agent, or Firm*—Stites & Harbison, PLLC; Juan Carlos A. Marquez, Esq.

(57) ABSTRACT

A mass spectrometer that is switchable to operate as a linear trap or as a mass filter, and attaining both high ejection efficiency when operated as a linear trap and high mass resolving power when operated as a mass filter. A mass spectrometer includes an ion source for ionizing a sample, a linear trap quadrupole rod lens supplied with ionized ions, a trap electrode for forming a potential to trap the supplied ions between one end of the quadrupole lens and the other end, a control unit to regulate the trap lens voltage, and a mass analyzer or detector to detect ions ejected from the linear trap, and characterized in switching between an operation where the supplied ions are trapped in a section quadrupole rod lens and ejected by the controller unit regulating the trap electrode voltage; and an operation where ions are selective passed through according to their mass. The ejection efficiency when operated as an ion trap, and the mass resolving power when operated as a quadrupole mass filter are vastly improved compared to conventional methods.

18 Claims, 14 Drawing Sheets

MASS SPECTROMETER AND MASS SPECTROMETRY METHOD

CLAIM OF PRIORITY

The present invention claims priority from Japanese application JP 2006-316462 filed on Nov. 24, 2006, the content of which is hereby incorporated by reference into this application.

FIELD OF THE INVENTION

The present invention relates to a mass spectrometer and mass spectrometry method thereof.

BACKGROUND OF THE INVENTION

The linear trap interior is capable of $MS^n$ analysis and widely utilized in proteome analysis. Mass selective ejection of ions trapped inside linear ion trap performed in the related art as described next.

An example of technology for mass selective ion ejection from the linear trap is disclosed in U.S. Pat. No. 5,420,425. After accumulating axially injected ions inside the linear trap, ion selection and ion disassociation performed as needed. A supplemental AC field is then applied across an opposing pair of quadrupole rod lenses, and specified ions can be excited along the radial direction. Ions are then selectively ejected towards the radial direction according to their mass by scanning the trapping RF voltage. A pseudoharmonic potential formed by a linear quadrupole RF field along the radial direction is utilized for mass separation, and possesses high mass resolving power.

Another example of technology for mass selective ion ejection is disclosed in U.S. Pat. No. 6,177,668. Ion selection and ion separation (disassociation) are performed as needed after accumulating axially injected ions. Ions can then be excited along the radial direction by applying a supplemental AC voltage across an opposing pair of quadrupole rod lenses. The ions are then axially selectively ejected by a fringing field generated between the quadrupole rod lens and the exit lens. The frequency of the supplemental AC voltage or the amplitude of the trapping RF voltage is then scanned. A pseudoharmonic potential formed by a RF field along the radial direction is utilized for mass separation, and the mass resolving power is high. The RF voltage renders little effect along the axis and the ejection energy is small.

Yet another example of technology for mass selective ion ejection in the linear trap is disclosed in U.S. Pat. No. 5,783,824. Ions input along the axial direction are accumulated. A vane lens is inserted between the quadrupole rod lenses. A DC bias is applied across the vane electrode and rod lens to form a pseudoharmonic potential along the central axis of the linear trap. Ions are then mass selectively ejected along the axial direction by applying a supplemental AC voltage across the vane lens. The amplitude of DC bias or frequency of the supplemental AC voltage is then scanned. The effect of the RF voltage is low around the central axis, thus ejected ions have little ejection energy.

A mass spectrometry method utilizing a quadrupole mass filter is also known in the conventional art and is widely utilized since operation is simple. An example of the quadrupole mass filter is described in U.S. Pat. No. 2,950,389. In this method, a linear quadrupole RF field and a linear quadrupole DC field are combined at respectively appropriate intensities, and the quadrupole mass filter selectively passes only those ions with a specified mass to charge ratio. The longer the quadrupole rod lens length along the axis, the better the resolving power of the quadrupole mass filter is obtained. The mass resolving power improves because the longer the quadrupole rod lens length along the axis, the longer the ions exist within the quadrupole potential.

A method jointly using the quadrupole mass filter with the linear trap method disclosed in U.S. Pat. No. 6,177,668 is described in Rapid Communication in Mass Spectrometry journal, Vol. 16, 512 pages (2002). The same mass analyzer unit can be operated as a quadrupole mass filter or as a linear trap by switching the voltage applied to the electrode (lens). When operated as a quadrupole mass filter, a linear quadrupole RF field and a linear quadrupole DC field are each combined at an appropriate intensity that selectively passes only ions of a specified mass. On the other hand, when operated as a linear trap by the method disclosed in U.S. Pat. No. 6,177,668, then ions are trapped across the total region of the quadrupole rod lens and the ions then selectively ejected by mass by applying a supplemental AC voltage. The linear trap by the method disclosed in U.S. Pat. No. 6,177,668 cannot trap ions only in a section of the quadrupole rod lens and must always trap ions over the total region of the quadrupole rod lens.

SUMMARY OF THE INVENTION

The object of the present invention is to provide a mass spectrometer capable of operating as a linear trap with high ejection efficiency and also a low spatial spread of ejected ions, and capable of switching to operate as a mass filter with high mass resolving power. Achieving a mass spectrometer with the above performance would also improve the duty cycle.

The above patent documents 1 through 3 only disclose methods for operating the rod section as a linear trap and there is no description whatsoever about operation as a quadrupole mass filter.

In U.S. Pat. No. 2,950,389, there is no description of joint use of a linear trap and a quadrupole mass filter.

During ion trap operation in Rapid Communication in Mass Spectrometry journal, Vol. 16, 512 pages (2002), the ions are ejected along the axial direction by utilizing a fringing field. This fringing field is only present in the vicinity of the end of the quadrupole rod lens and so only ions near the end of the quadrupole rod lens can be ejected. Increasing the trap length as a countermeasure causes a drop in ejection efficiency. On the other hand a long rod is required to obtain high resolving power when operated as a quadrupole mass filter so dual operation is impossible to achieve.

The mass spectrometer and mass spectrometry method of this invention is characterized by operation to trap and eject ions supplied to a section of a multipole rod lens, and operation to selectively pass ions by mass, by regulating a second lens installed between one end of the multipole rod lens and the other end. The second lens (electrode) here is the lens installed between one end and the other end of a multipole rod lens, when that multipole rod lens is the first lens.

When operating to trap and eject the supplied ions in a section of the multipole rod lens, the voltage of the second lens (electrode) is regulated to trap the supplied ions between the one end of the multipole rod lens and the second lens and/or regulate the voltage of the output end lens and the second lens, to trap the supplied ions between the output end lens and the second lens.

Also, when operating to pass ions selectively by mass, control is exerted to eliminate the difference in voltage potential between the second lens and the multipole rod lens. Also, the voltage on the multipole rod lens is changed to allow the detector to acquire the mass spectrum.

The mass spectrometry method of this invention is characterized by operation to switch between: a process utilizing a second lens installed between one end and the other end of a multipole rod lens to trap and oscillate the supplied ions in a section of the multipole rod lens, and regulating the voltage of the second lens to eject the oscillated ions along the center axis of the multipole rod lens; and a process for filtering the supplied ions according to mass by exerting control to eliminate the difference in voltage potential between the second lens and multipole rod lens.

This invention achieves a mass spectrometer capable switching between operation as a linear trap with high ejection efficiency and operation as a mass filter with high mass resolving power.

DETAILED DESCRIPTION OF THE PREFERRED EMBODIMENTS

First Embodiment

Figure 1A:
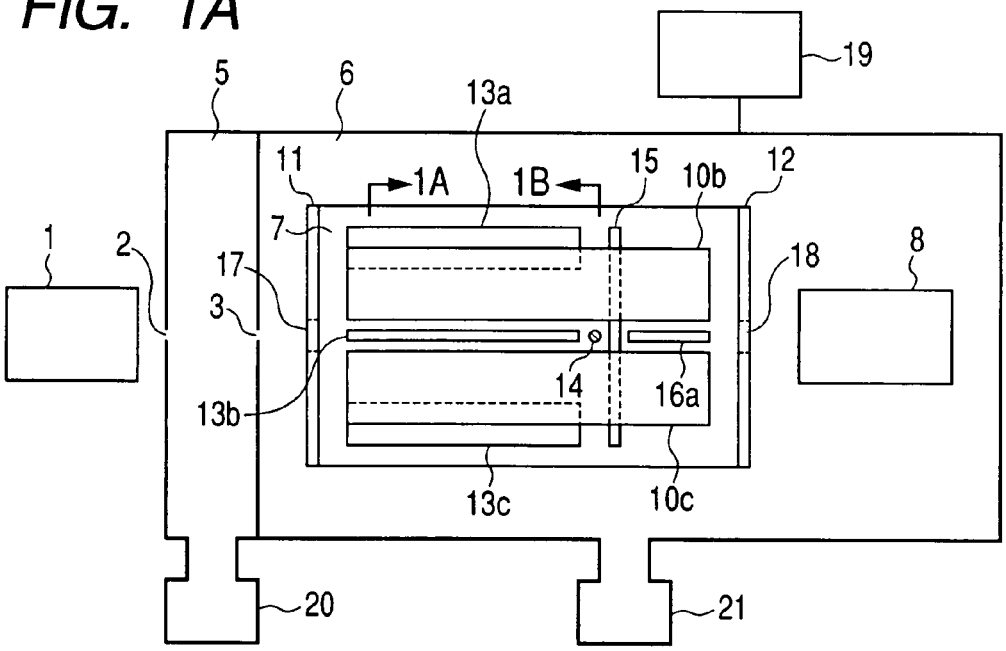
FIG. 1A is a diagram of the mass spectrometer of the first embodiment.
Figure 1B:
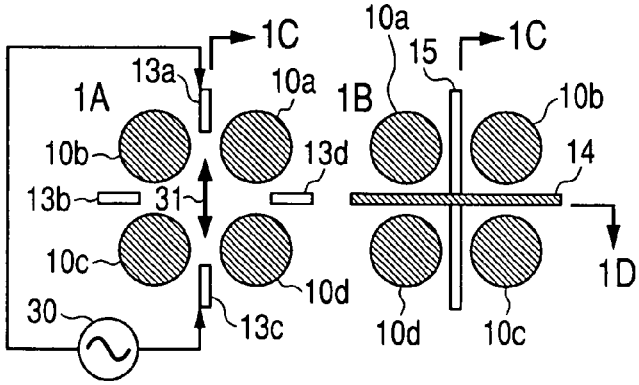
FIG. 1B is a cross sectional view.
Figure 1C:
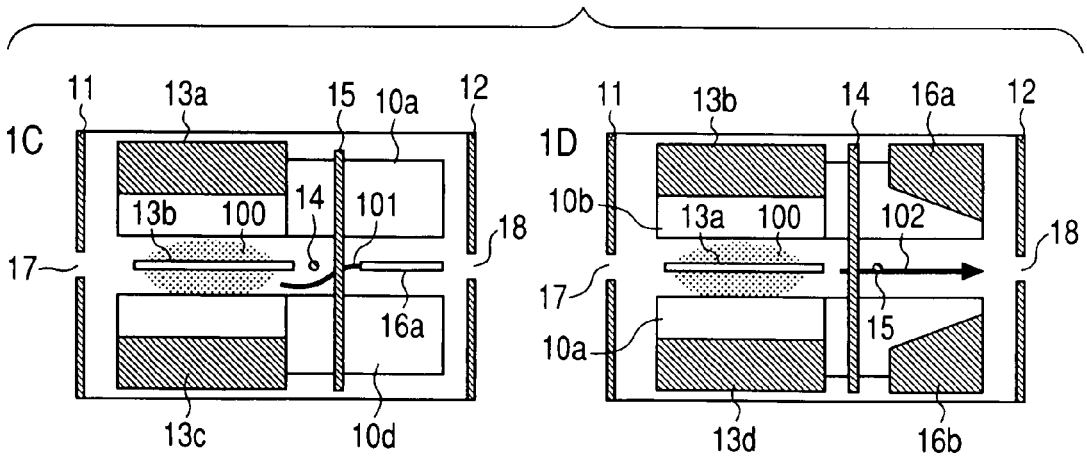
FIG. 1C is a cross sectional view.

FIG. 1 is diagrams of the mass spectrometer of the method for this invention. FIG. 1A is a block diagram of the overall mass spectrometer. FIG. 1B is a cross sectional view of the device along the radial direction. FIG. 1C is a cross sectional view along the axis of the linear trap. FIGS. 1A, 1B, and 1C are cross sectional views as seen from the direction of the arrow. Ions generated in an ion source 1 such as an electrospray ion source, atmospheric pressure chemical ionization source, atmospheric pressure photo-ionization source, atmospheric pressure matrix assisted laser desorption ionization source, matrix assisted laser desorption ionization source, are supplied via an aperture 2 into a differential exhaust portion 5. A pump 20 exhausts the differential exhaust portion. The ions from the differential exhaust portion pass through an aperture 3 and are supplied into an analyzer 6. The pump 21 exhausts the analyzer section to maintain it at a $10^{-4}$ Torr or lower ($1.3\times10^{-2}$ Pa or less). The ions that passed through the aperture 17 enter the mass analyzer unit 7. In the mass analyzer unit, the controller unit 19 regulates the voltage to the lenses (electrodes) making up the linear trap section. The exit lens 12 accelerates the ions ejected from the mass analyzer unit, and the ions pass through the apertures 18 and are detected by the detector 8. Types combining electron multipliers or scintillators with photo-electron multiplier tubes are typically utilized as detectors.

Operation of this invention as a linear trap is described first. During operation as a linear trap, buffer gas is supplied to the mass analyzer unit 7 and maintained at $10^{-4}$ Torr -$10^{-2}$ Torr ($1.3\times10^{-2}$ Pa–1.3 Pa). The supplied ions are trapped in regions enclosed by the input lens 11, quadrupole rod lens 10, prevane lens 13, and trap lens 14. Among the ions trapped in these regions, ions at a designated mass are resonance-oscillated by a method described later on, and ejected along the axis by an extraction field formed by the extraction lens 15. FIG. 1 shows a concept view of the trajectory 101 of the ejected ions at this time. The trap lens 14, extraction lens 15 may be positioned in the vicinity of the trajectory taken by the ions by utilizing a thin-plated lens (electrode) or utilizing a wire-shaped lens. The wire-shaped lens possesses lower ion transmittance loss but the lens shape is more difficult to manufacture. Typical application voltages for measuring positive ions are described next. Operation as a linear trap is possible even without the rear vane lens 16 but ions can be ejected with higher efficiency by using the rear vane lens 16.

Figure 2:
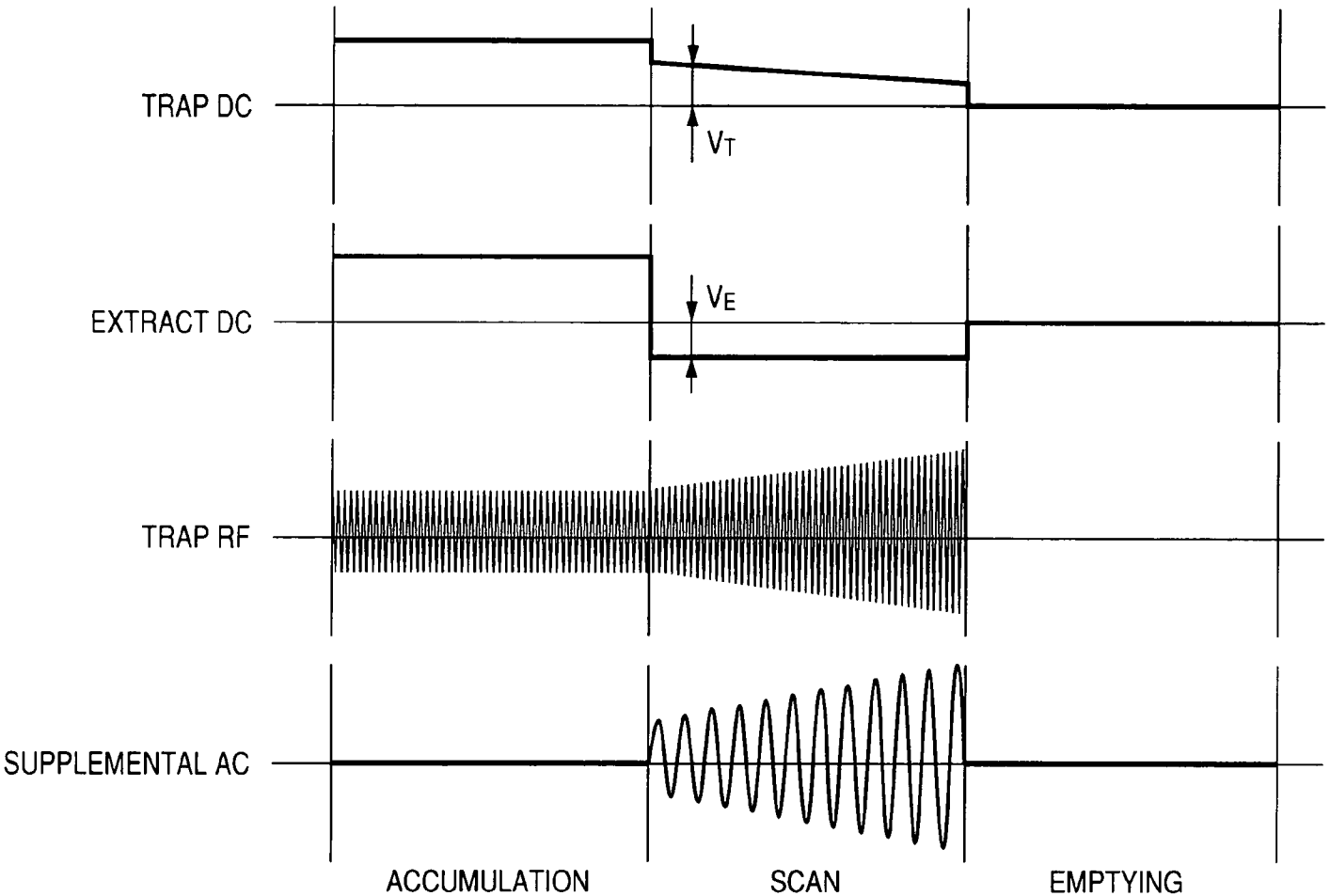
FIG. 2 is a graph showing the sequence measurement during the linear trap operation in the first embodiment.

FIG. 2 shows the measurement sequence. A voltage of ± several dozen volts may at times be applied by the front and rear lenses (electrodes) to the offset potential of quadrupole rod lens 10 but when describing voltages on each lens of quadrupole rod lens 10 from hereon, the offset voltage potential of quadrupole rod lens 10 is defined as a value of 0. An RF voltage (trap RF voltage) of approximately 500 kHz to 2 MHz, and amplitude of 100 to 5,000 volts is applied to the quadrupole rod lens 10. Trap RF voltages of the same phase are applied to the opposing quadrupole rod lenses (in this figure (10*a*, 10*c*) and (10*b*, 10*d*): hereafter complying with this definition)). Conversely, a reversed phase trap RF voltage is applied to the adjoining quadrupole rod lenses (in this figure (10*a*, 10*b*), (10*b*, 10*c*), (10*c*, 10*d*) and (10*d*, 10*a*): hereafter complying with this definition).

Measurement is performed in three sequences. The amplitude of the trap RF voltage is set between approximately 100 to 1,000 volts during the trap period. Typical voltages applied to the other lenses are; setting the inlet lens 11 to 20 volts, the prevane lens 13 to 0 volts, and trap lens 14 to 20 volts, the extract lens 15 to 20 volts, the rear vane lens 16 and the exit lens 12 to approximately 20 volts. The trap RF voltage forms a pseudo-potential along the radial direction of the quadrupole lens field and a DC potential is formed along the center axis of the quadrupole lens field so that nearly 100 percent of the ions that pass through the aperture 17 are trapped in the region 100 enclosed by the inlet lens 11, quadrupole rod lens 10, prevane lens 13, and trap lens 14. The length of the accumulation period is greatly depend on the ion supply quantity to the linear trap, and is approximately 1 ms -1,000 ms. The ion quantity increases when the trap period is too long and a phenomenon called the space charge occurs in the interior of the linear trap. This space charge phenomenon causes problems such as a shift in the position of the spectrum mass number during the mass scan described later. Conversely, an ion quantity that is too small causes a statistical error that prevents obtaining a mass spectrum with an adequate S/N (signal-to-noise) ratio.

Next, during the mass scan period, the trap RF voltage amplitude is scanned from low (100-1,000 volts) to high (500-5,000 volts) and ions are sequentially ejected. The inlet lens voltage is set to 20 volts and the rear vane lens 16, output lens 12 are set from −10 volts to −40 volts. A voltage of approximately 3 to 10 volts is applied to the trap lens 14 and a voltage of approximately −10 to −40 volts is applied to the extract lens 15. When the voltage of the trap lens 14 is swept at this period from high (10 to 8 volts) to low (3 to 4 volts), a mass spectrum can be obtained with a wider mass range in the first scan. The prevane lenses 13 are inserted between the respective adjacent quadrupole rod lenses 10. A supplemental AC voltage (amplitude 0.01 volt to 1 volt, frequency 10 kHz-500 kHz) is applied between the pair of opposing prevane lenses 13*a*, 13*c*. The supplemental resonance field at this time intersects the trap lens direction by 90 degrees and lens extraction direction, and is selected to match the same direction as the extraction lens direction (direction 13*a*-13*c* in the figure). The amplitude of the supplemental AC voltage may be made a fixed value; however a spectrum with good resolving power and a wider range can be obtained by varying the amplitude value of the supplemental AC voltage during the scan. Ions resonating at the designated mass range are made to oscillate towards the intermediate direction 31 of the adjacent quadrupole rod lens. Ions whose amplitude of radial distribution has expanded reach the region made by the electrical field generated by the difference in voltage potential (VT-VE) between the trap lens 14 and the extraction lens 15 and are ejected along the axial direction. The trajectory 101 of the ions ejected at this time is shown in a concept view in FIG. 1.

The relation between the trap RF voltage amplitude $V_{RF}$ and the mass number m/z is shown in (Eq. 1) the following equation.

$$m/z = \frac{4e \cdot V_{RF}}{q_{ej} r_0^2 \Omega^2} \qquad \text{[Equation 1]}$$

Figure 3:
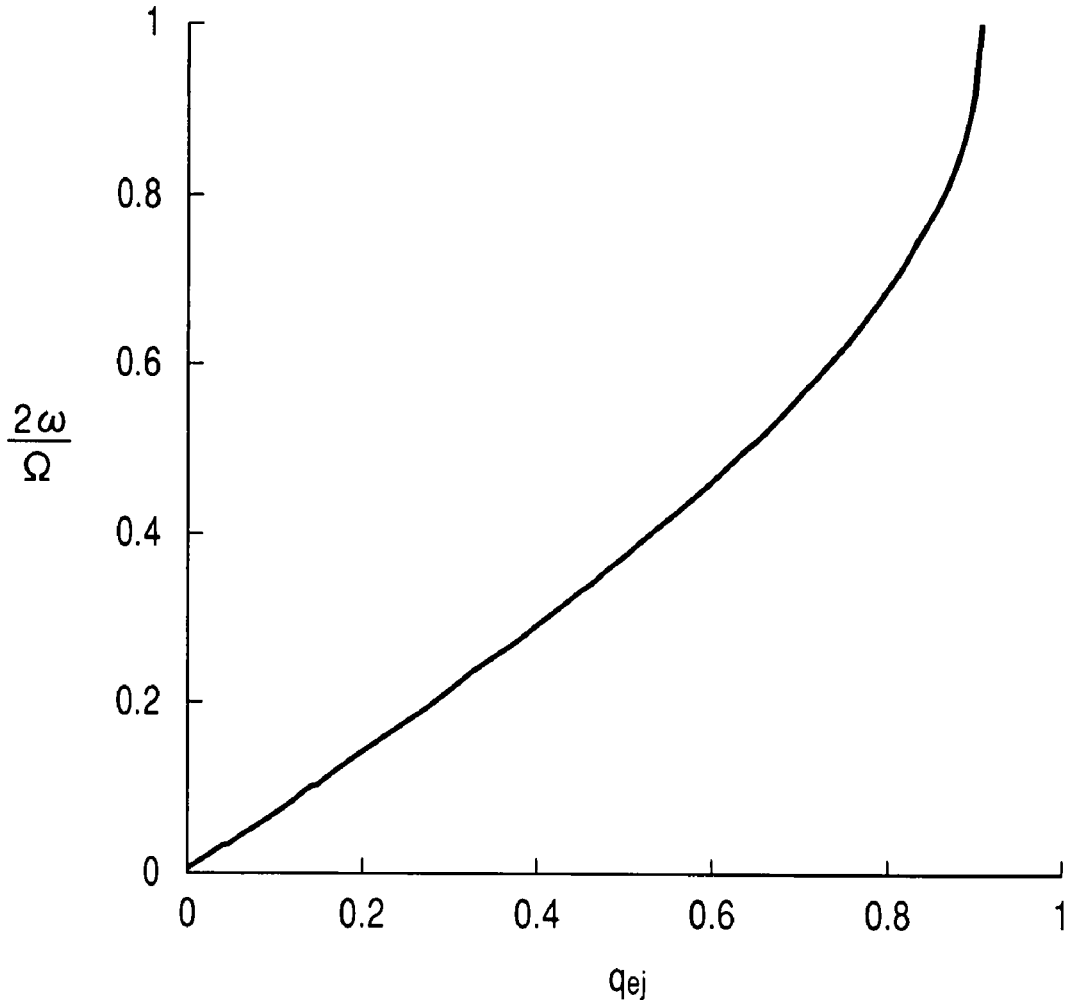
FIG. 3 is a graph showing the effect of the method of this invention.

At this time, r0 is the distance between the center of the quadrupole lens and the rod lens 10. Also, $q_{ej}$ is the value calculated unilaterally from the ratio of the angular frequency of ω supplemental AC voltage and the angular frequency Ω of the trap RF voltage. This relation is shown in FIG. 3. The mass spectrum can therefore be obtained by establishing a relation between $V_{RF}$ and m/z in this way. If just the primary resonance is considered, then the higher the frequency of the supplemental AC frequency, the lower the mass, and the lower the frequency, the higher the mass of the ion. The mass scan period length is from approximately 10 ms to 200 ms and largely proportional to the range of the mass for detection. Finally, all voltages are set to 0 during the ejection period, and the ions are all ejected outside the trap. By repeating the above three sequences, a mass spectrum with a good S/N ratio can be integrated. The ejection period length is approximately 1 ms. An ion cooling period of several ms may also be incorporated into sequences other than the above three sequences. Setting the start conditions in the following sequence to the same values as the ion cooling period allows stabilizing the initial ion state.

Figure 4:
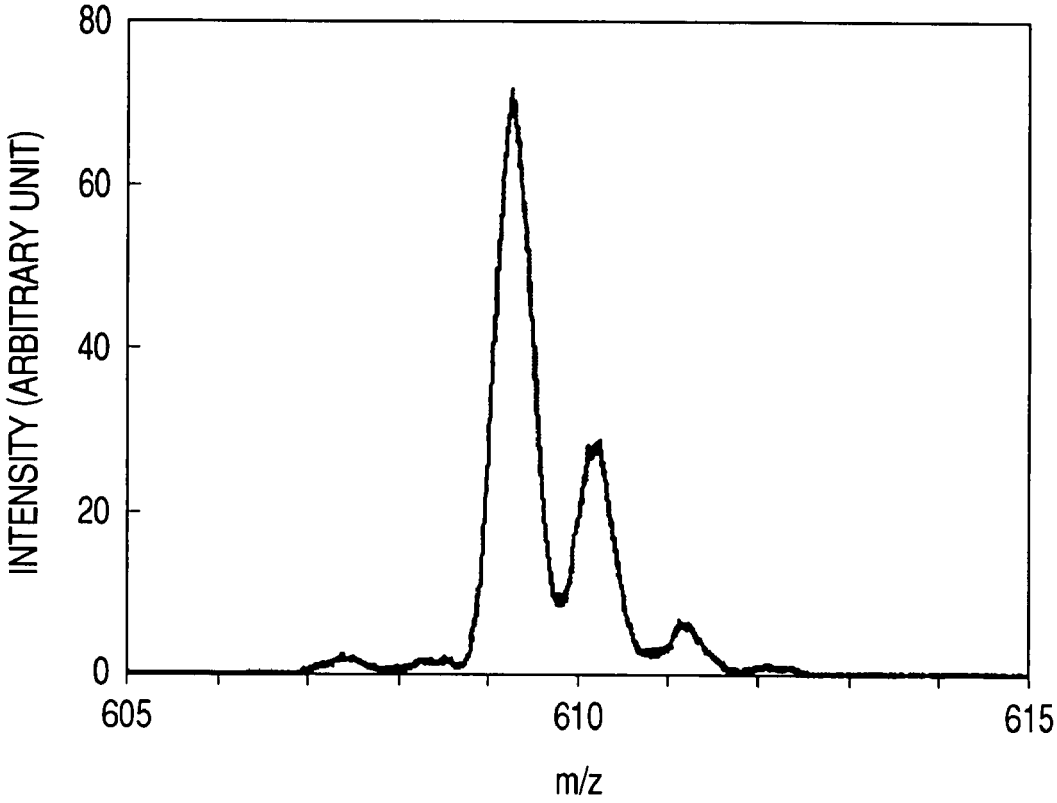
FIG. 4 is a graph showing the effect of the method of this invention.

The mass spectrum obtained in this way is shown in FIG. 4. A reserpine/methanol solution of 1 ppm was ionized by the electro-spray ionization. The spectrum was measured at a scan speed of 1,000 Th/sec, and a supplemental AC voltage frequency of 250 kHz. Isotope peaks (609.3, 610.3, 611.3) of reserpine ions can be detected while separated in concentrations in 1 Th each. A mass resolving power of (M/ΔM) 1200 can be obtained from a half value width of approximately 0.5 Th. Results comparing the intensity of ions ejected by the DC electrical field were approximately 50 percent of the ion ejection efficiency at this time. The ejection efficiency in linear traps along the axis in the conventional art is 10 to 20 percent (Rapid Communication in Mass Spectrometry journal, Vol. 16, 512 pages (2002)), so the ejection efficiency of this method is higher than the conventional method. Moreover in this method, ions are trapped in one section of the quadrupole rod so the ejection efficiency during linear trapping is not dependent on the length of the quadrupole rod lens.

The case when operating the spectrometer as a quadrupole mass filter is described next. The device structure up to the ions arriving at the mass analyzer unit and the device structure from the mass analysis unit onward is the same as the linear trap operation so a description is omitted here.

Figure 5A:
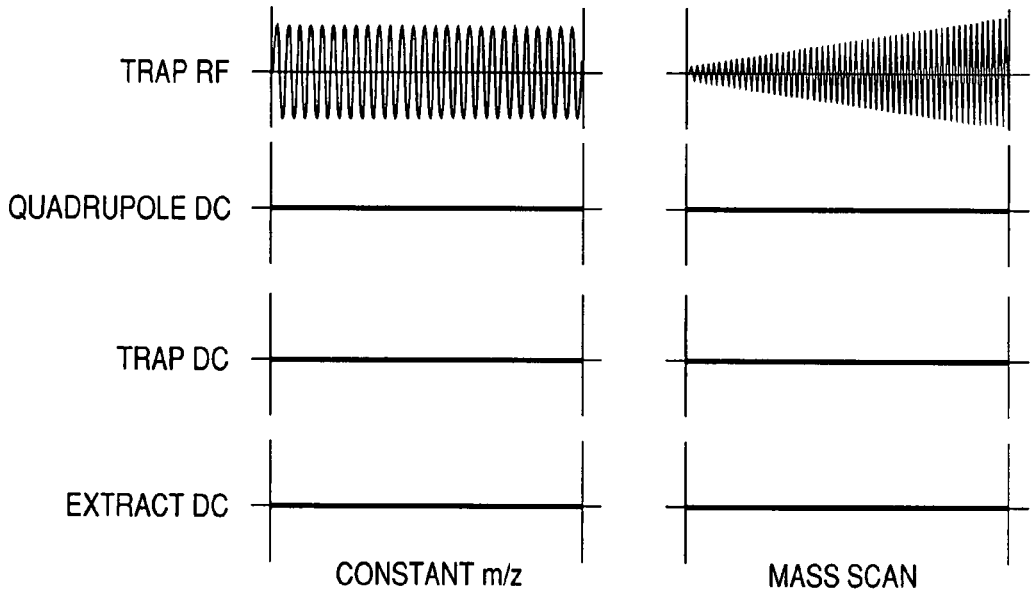
FIG. 5A is a drawing showing the measurement sequence during operation as a quadrupole mass filter of the method of this invention.

During operation as a quadrupole mass filter, buffer gas is not supplied to the mass analyzer unit 7 and pressure is maintained at $10^{-5}$ Torr-$10^{-4}$ Torr ($1.3\times10^{-3}$ Pa–$1.3\times10^{-2}$ Pa). FIG. 5A shows an example of voltages applied when utilized as a quadrupole mass filter. The same RF trap voltage (amplitude 100-5,000 volts, frequency 500 kHz-2 MHz) is applied to the quadrupole rod lens 10 as when operated as a linear trap. The trap lens 14, the extraction lens 15, the prevane lens 13 and the rear vane lens 16 are set to 0 volts, and approximately 5 to 40 volts is applied to the exit lens 12. A typical voltage applied to the other lens (electrodes) is setting the inlet lens 11 to 0 volts. The supplied ions are then selectively ejected by a fringing field generated between the end of the quadrupole rod lens 10 and the exit lens 12. During this time, the trap RF voltage amplitude is scanned from low (100-1,000 volts) to high (500-5,000 volts) or from high (500-5,000 volts) to low (100-1,000 volts) to obtain the mass spectrum. Just those ions designated as m/z can be continuously passed by maintaining a fixed trap RF voltage amplitude. If the offset voltage potential of the quadrupole rod lens is not at 0, then the voltage potential of the trap lens 14 and the extraction lens 15 are regulated to reach a voltage potential equal to the offset voltage potential.

Figure 5B:
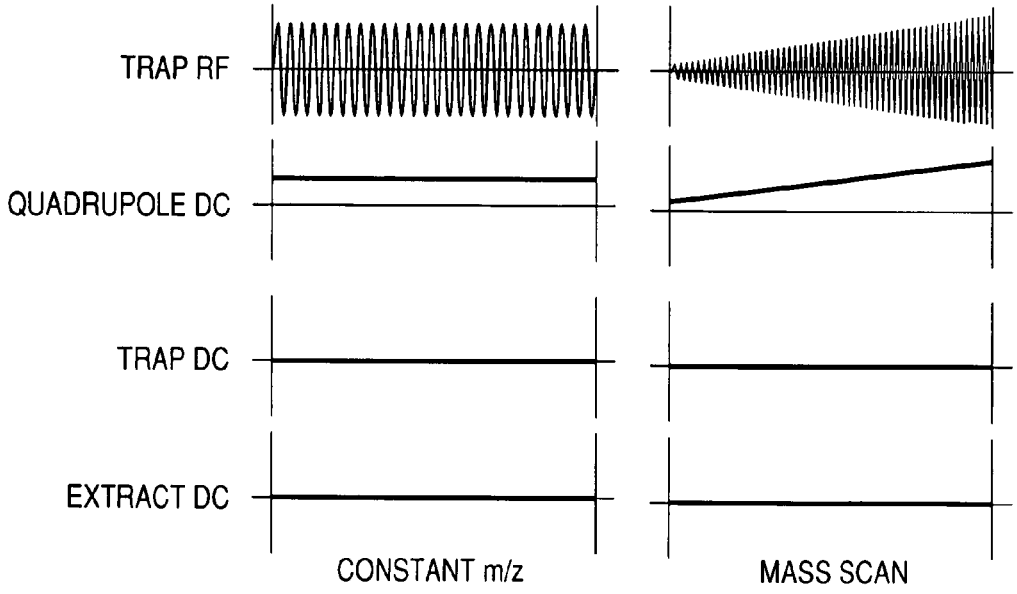
FIG. 5B is a drawing showing the measurement sequence during operation as a quadrupole mass filter of the method of this invention.

A DC voltage (10-1,000 volts) or AC voltage (100-5,000 volts) can also be applied to the quadrupole rod lens 10 to make it operate like a normal quadrupole mass filter. Here a DC voltage of the same polarity is applied to the opposing quadrupole rod lenses 10 and a voltage (quadrupole DC voltage) of opposite polarity is applied across the adjacent quadrupole rod lenses. An example of applying a voltage at this time is shown in FIG. 5B. Here the trap RF voltage and the quadrupole DC voltage are selected so that only ions the desired ions that can oscillate stably in the quadrupole lens electrical field will pass through the quadrupole mass filter in the vicinity of m/z. In this case also, the mass spectrum is obtained by applying quadrupole DC voltage (10-1,000 volts) and a trap RF voltage (100-5,000 volts) maintained at a fixed ratio and sweeping the voltages, to the quadrupole rod lens 10. Moreover, just those ions at a designated m/z can be continuously passed (through the filter), by maintaining a fixed trap RF voltage and quadrupole DC voltage. FIG. 1 shows the trajectory 102 of the ions passing through the quadrupole mass filter.

Buffer gas can be supplied to the mass spectrometer installed with a gas valve when operated as a linear trap, and during operation as a quadrupole lens mass filter the supply of gas can be stopped via the gas valve to improve the ion transmittance and the mass resolving power when operated as a quadrupole mass filter. The controller unit 19 can regulate this operation.

The mass resolving power of the quadrupole mass filter generally becomes higher, the longer the length of quadrupole rod lens 10. The method of this invention traps the ions in a section of the quadrupole rod so that ion ejection efficiency is not dependent on the length of the quadrupole rod. This method therefore drastically improves the mass resolving power during operation as a quadrupole mass filter compared to the conventional method and the length of the quadrupole rod will be sufficient.

Figure 6:
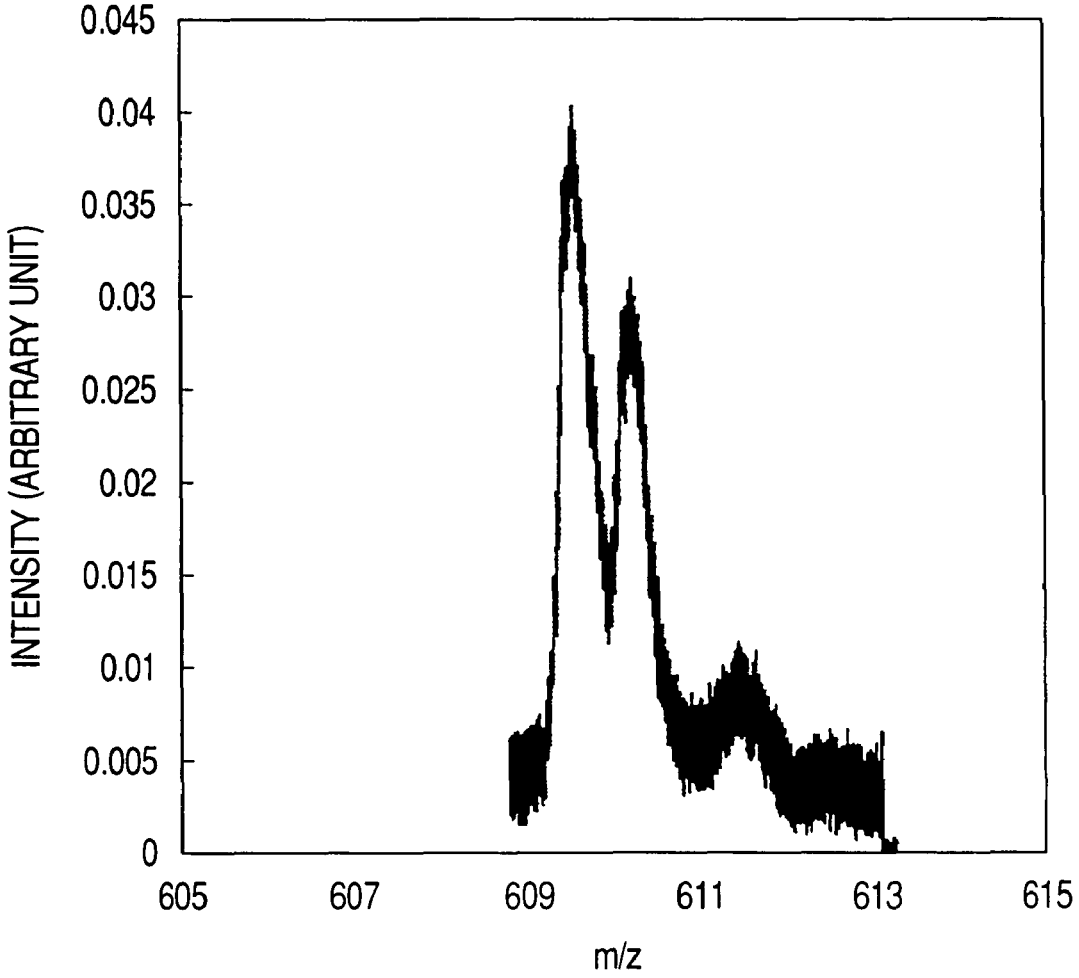
FIG. 6 is a drawing for describing the effect of the method of this invention.

The mass spectrum obtained by this method is shown in FIG. 6. A reserpine/methanol solution of 100 ppm was electro-sprayed and ionized. The spectrum was measured at a scan speed of 100 Th/sec, and a trap RF frequency of 780 kHz. Ion peaks were confirmed at the mass number 609.3, 610.3, 611.3. Among these a mass resolving power of ($M/\Delta M>1000$) was obtained from an ion peak with the mass number of 609.3.

Second Embodiment

Figure 7:
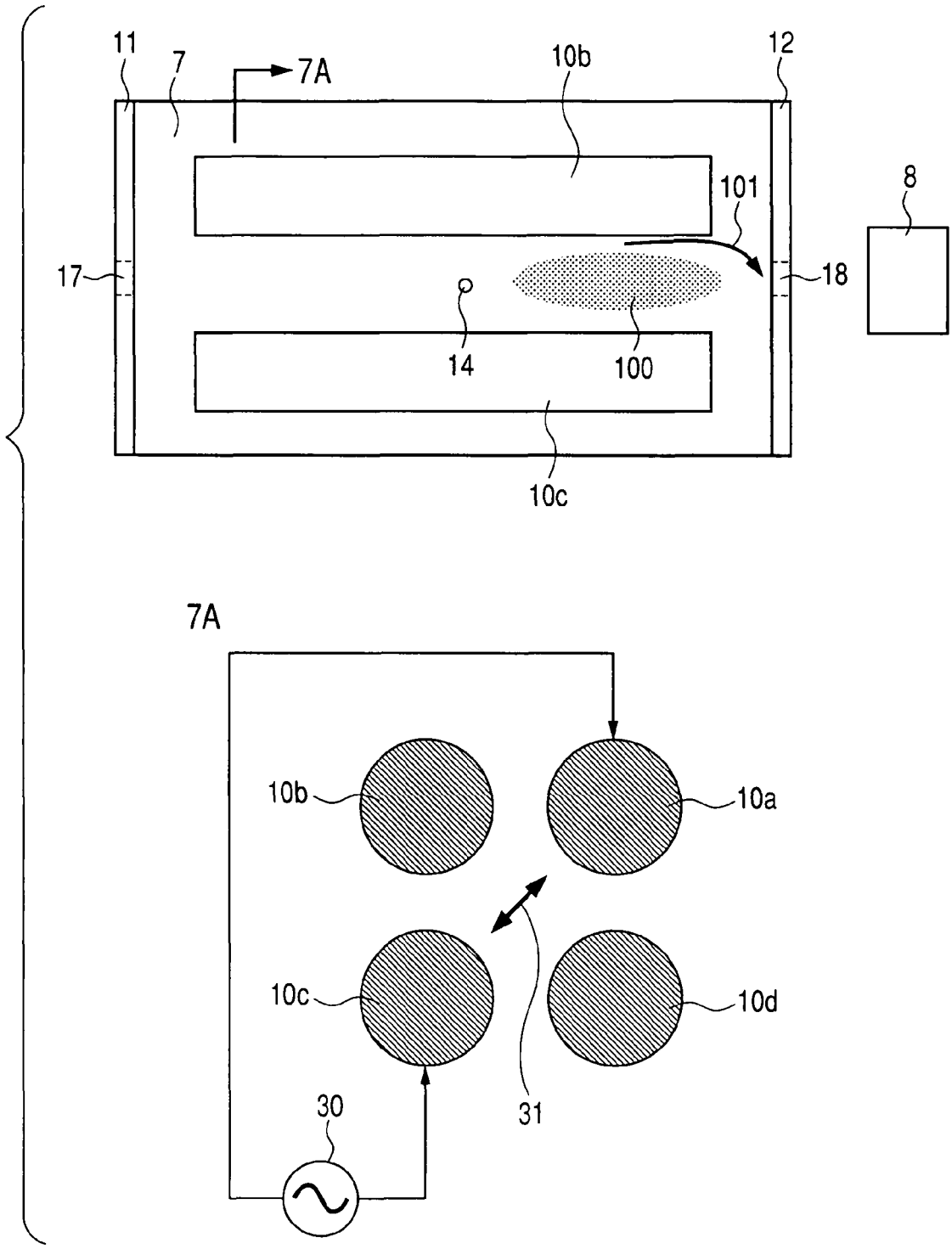
FIG. 7 shows a diagram of the mass spectrometer of the second embodiment and the cross sectional view.

FIG. 7 is diagrams of the mass spectrometer of this method. 7A in FIG. 7 shows a cross sectional view. The device structure up to the ions arriving at the mass analyzer unit and the structure from the mass analysis unit onward is the same as the first embodiment so a description is omitted here.

Linear trap operation is described first. During operation as a linear trap, buffer gas is supplied to the mass analyzer unit 7 and maintained at $10^{-4}$ Torr-$10^{-2}$ Torr ($1.3\times10^{-2}$ Pa–1.3 Pa). The trap lens 14 may utilize a thin-plated lens (electrode) or a wire-shaped lens (electrode). The wire-shaped lens possesses lower ion transmittance loss but the lens shape is more difficult to manufacture.

Figure 8:
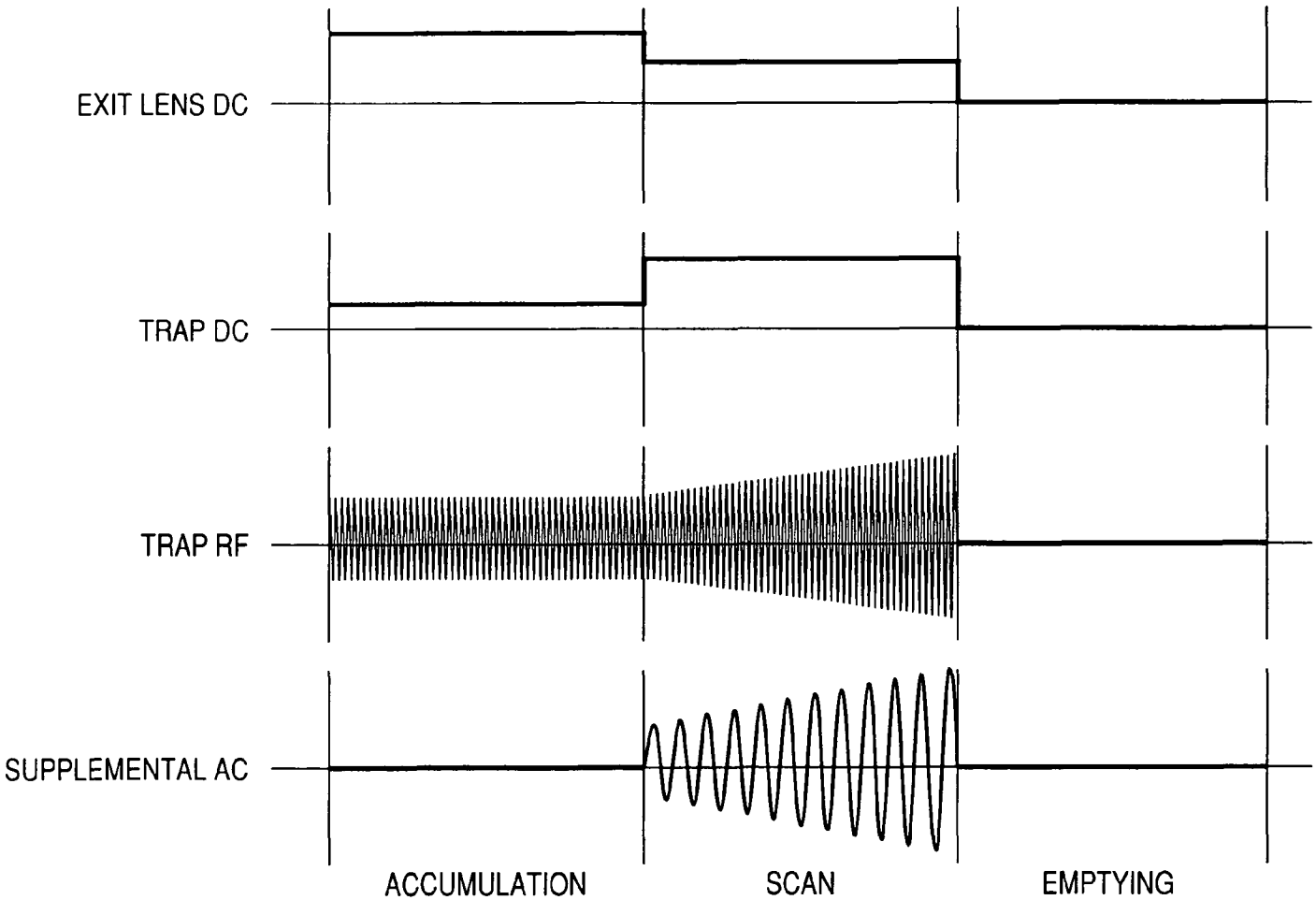
FIG. 8 is a graph showing the sequence measurement during linear trap operation in the second embodiment.

FIG. 8 shows the measurement sequence. Measurement was performed in three sequences. A trap RF voltage (amplitude 100 volts-5,000 volts, frequency 500 kHz-2 MHz) was applied to the quadrupole rod lens 10 during the trap period.

Typical voltages applied to the other lenses are; setting the inlet lens 11 from 5 to 20 volts, the trap lens 14 from 5 to 20 volts, the exit lens 12 from 10 to 50 volts. The trap RF voltage forms a pseudo-potential along the radial direction of the quadrupole lens, and DC voltage on outlet 12 and the trap lens 14 forms DC along the center axis of the quadrupole field Therefore in this second embodiment, the supplied ions are trapped in the region 100 enclosed by the trap lens 14, quadrupole rod lens 10, and the exit lens 12. Next, a supplemental AC voltage (amplitude 0.1 to 1 volt, frequency 10 kHz-500 kHz) is applied across the pair of opposing quadrupole rod lens during the mass scan period. Typical voltages applied to other electrodes (lenses) are 10 to 50 volts to the inlet lens 11, 10 to 50 volts to the trap lens 14, an approximately 5 to 30 volts to the exit lens 12. Ions are excited along the radial direction by the supplemental AC voltage and ejected along the axis by the fringing field between the end of the quadrupole rod lens 10 and the exit lens 12. FIG. 7 shows a concept view of the trajectory 101 of the ejected ions at this time. The trap RF voltage amplitude can be scanned from low (100-1,000 volts) to high (500-5,000 volts) to obtain the mass spectrum. The mass scan period length is from approximately 10 ms to 200 ms, and is largely proportional to the range of the mass for detection. Finally, all voltages are set to 0 during the ejection period, and the ions are all ejected outside the trap. The length of the ejection period is approximately 1 ms.

The case when operating the spectrometer as a quadrupole mass filter is described next. The device structure up to the ions arriving at the mass analyzer unit and the device structure from the mass analysis unit onward is the same as the linear trap operation so a description is omitted here. During operation as a quadrupole mass filter, buffer gas is not supplied to the mass analyzer unit 7 which is maintained at $10^{-5}$ Torr-$10^{-4}$ Torr ($1.3\times10^{-3}$ Pa–$1.3\times10^{-2}$ Pa). The trap lens 14 is set to 0 volts during operation as a quadrupole mass filter. Voltages applied to other lenses are the same as the first embodiment so their description is omitted here.

Compared to the first embodiment, the second embodiment possesses fewer electrodes (lenses) offering the advantage that the cost can be reduced. The effect that the vane lens applies to the quadrupole lens field has also been reduced so the mass resolving power is improved when operated as a linear trap but the power supply for applying voltages to the quadruple rod lens is complicated.

Third Embodiment

Figure 9:
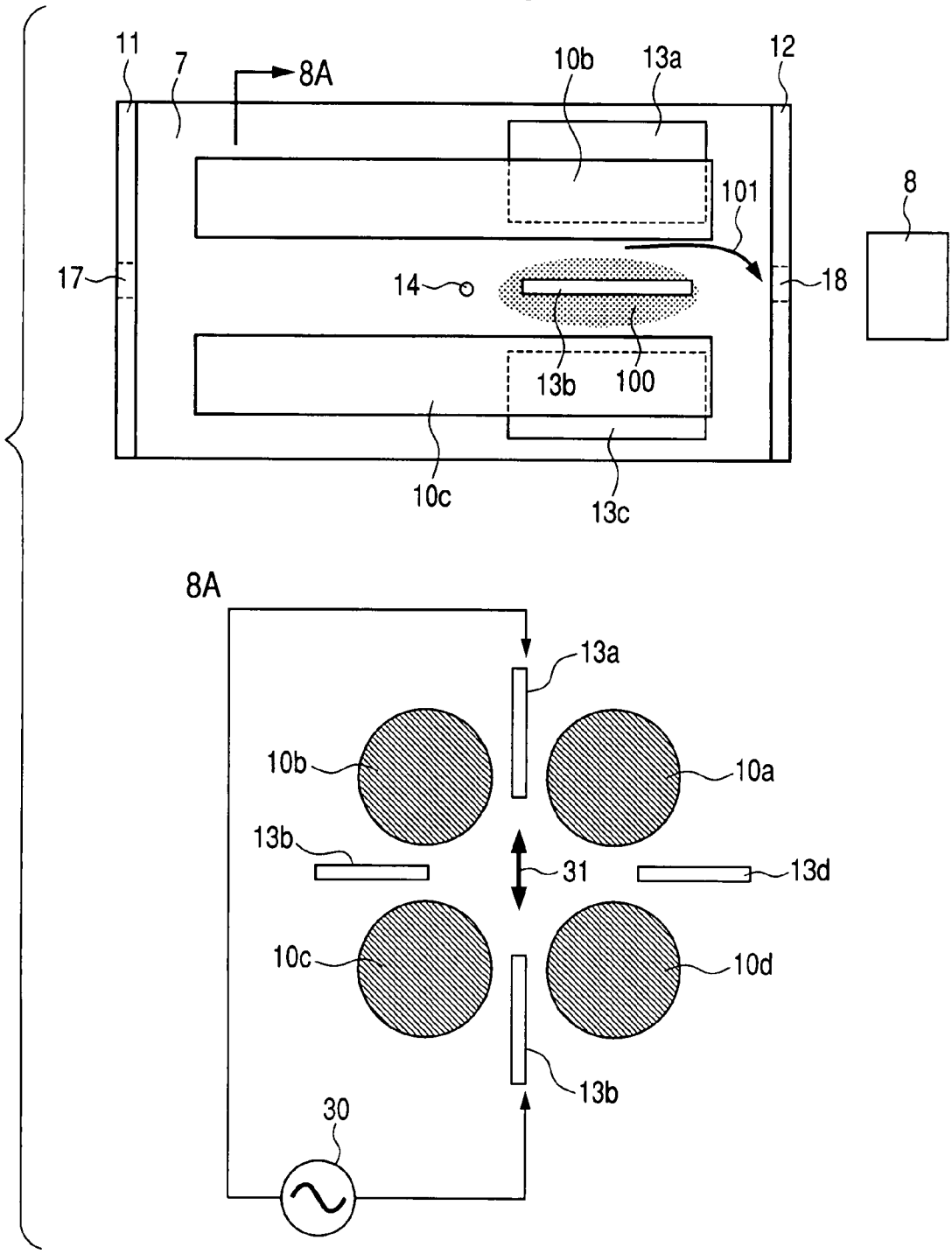
FIG. 9 shows a diagram of the mass spectrometer of the third embodiment and the cross sectional view.

FIG. 9 is a structural diagram of the mass spectrometer of this method. 8A in FIG. 9 indicates a cross sectional view. The device structure up to the ions arriving at the mass analyzer unit and the device structure from the mass analysis unit onward is the same as the first embodiment so a description is omitted here.

Operating the spectrometer as a linear trap is described first. During operation as a linear trap, buffer gas is supplied to the mass analyzer unit 7 and maintained at $10^{-4}$ Torr -$10^{-2}$ Torr ($1.3\times10^{-2}$ Pa–1.3 Pa. The trap lens 14 may utilize a thin-plated lens (electrode) or a wire-shaped lens (electrode). The wire-shaped lens possesses lower ion transmittance loss but the lens shape is more difficult to manufacture. Except for the fact that the supplemental AC voltage is applied to the vane lens 13 and not the quadrupole rod lens 10, the measurement sequence of the third embodiment is identical to the measurement sequence of the second embodiment. Measurement is performed in three sequences.

Next, a trap RF voltage (amplitude 100 volts-5,000 volts, frequency 500 kHz-2 MHz) was applied to the quadrupole rod lens 10 during the trap period. Typical voltages applied to the other lenses are; setting the inlet lens 11 from 5 to 20 volts, the trap lens 14 from 5 to 20 volts, and the exit lens 12 from 10 to 50 volts. The trap RF voltage forms a pseudo-potential along the radial direction of the quadrupole lens, and DC voltage on outlet 12 and the trap lens 14 forms DC along the center axis of the quadrupole field. Therefore in this third embodiment, the supplied ions are trapped in the region 100 enclosed by the trap lens 14, quadrupole rod lens 10, and the exit lens 12.

During the mass scan period, a supplemental AC voltage (amplitude 0.01 volts to 1 volt, frequency 10 kHz-500 kHz) is applied between the pair of opposing vane lenses 13 (*a, c*). Typical voltages applied to the other lenses are; setting the inlet lens 11 from 10 to 50 volts, the trap lens 14 from 10 to 50 volts, and the exit lens 12 from 5 to 30 volts. Ions are excited along the radial direction by the supplemental AC voltage and ejected along the axis by the fringing field between the end of the quadrupole rod lens 10 and the exit lens 12. FIG. 9 shows a concept view of the trajectory 101 of the ejected ions at this time. The trap RF voltage amplitude can be scanned from low (100-1,000 volts) to high (500-5,000 volts) to obtain the mass spectrum. The mass scan period length is from approximately 10 ms to 200 ms, and is largely proportional to the range of the mass for detection.

Lastly, all voltages are set to 0 during the ejection period, and the ions are all ejected outside the trap. The length of the ejection period is approximately 1 ms.

The case when operating the spectrometer as a quadrupole mass filter is described next. The device structure up to the ions arriving at the mass analyzer unit and the device structure from the mass analysis unit onward is the same as the linear trap operation so a description is omitted here. During operation as a quadrupole mass filter, buffer gas is not supplied to the mass analyzer unit 7 which is maintained at $10^{-5}$ Torr-$10^{-4}$ Torr ($1.3\times10^{-3}$ Pa–$1.3\times10^{-2}$ Pa). The trap lens 14 is set to 0 volts during operation as a quadrupole mass filter. Voltages applied to other lenses are the same as the first embodiment so their description is omitted here.

Compared to the first embodiment, the third embodiment possesses fewer lenses (electrodes) offering the advantage that the cost can be reduced. The power supply for applying voltages to the quadrupole rod lens is simple compared to that of the second embodiment but the mass resolving power is lower.

Fourth Embodiment

Figure 10A:
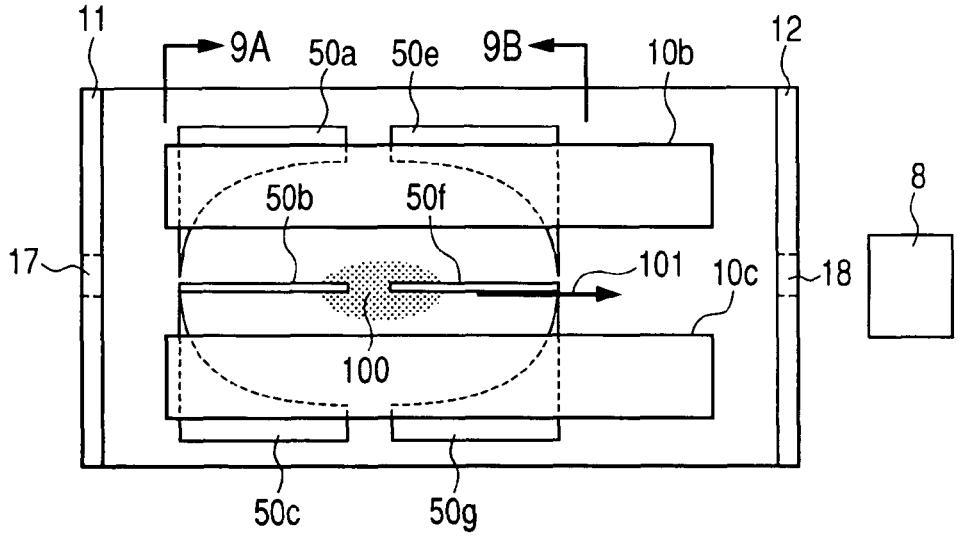
FIG. 10A is a diagram of the mass spectrometer of the fourth embodiment.
Figure 10B:
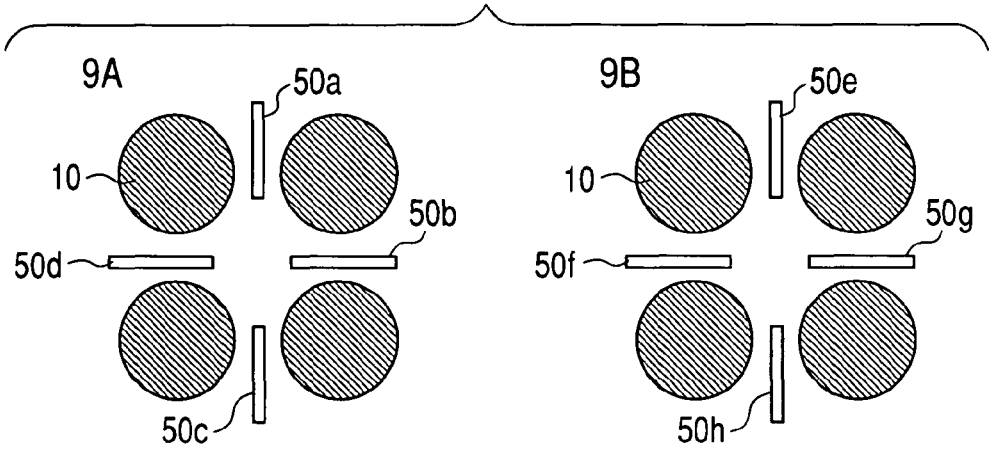
FIG. 10B is cross sectional views.
Figure 10C:
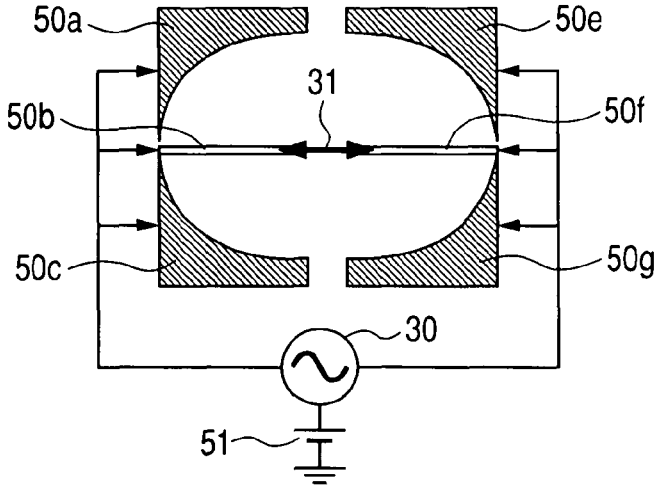
FIG. 10C is a drawing showing a voltage applied to the vane electrode.

FIG. 10A is a structural diagram of the mass spectrometer of this method. FIG. 10B is a cross sectional view. FIG. 10C shows the state where a voltage is applied to the vane lens 50. The device structure up to the ions arriving at the mass analyzer unit and the device structure from the mass analysis unit onward is the same as the first embodiment so a description is omitted here.

Operating the spectrometer as a linear trap is described next. During operation as a linear trap, buffer gas is supplied to the mass analyzer unit 7 and maintained at $10^{-4}$ Torr-$10^{-2}$ Torr ($1.3\times10^{-2}$ Pa–1.3 Pa).

Figure 11:
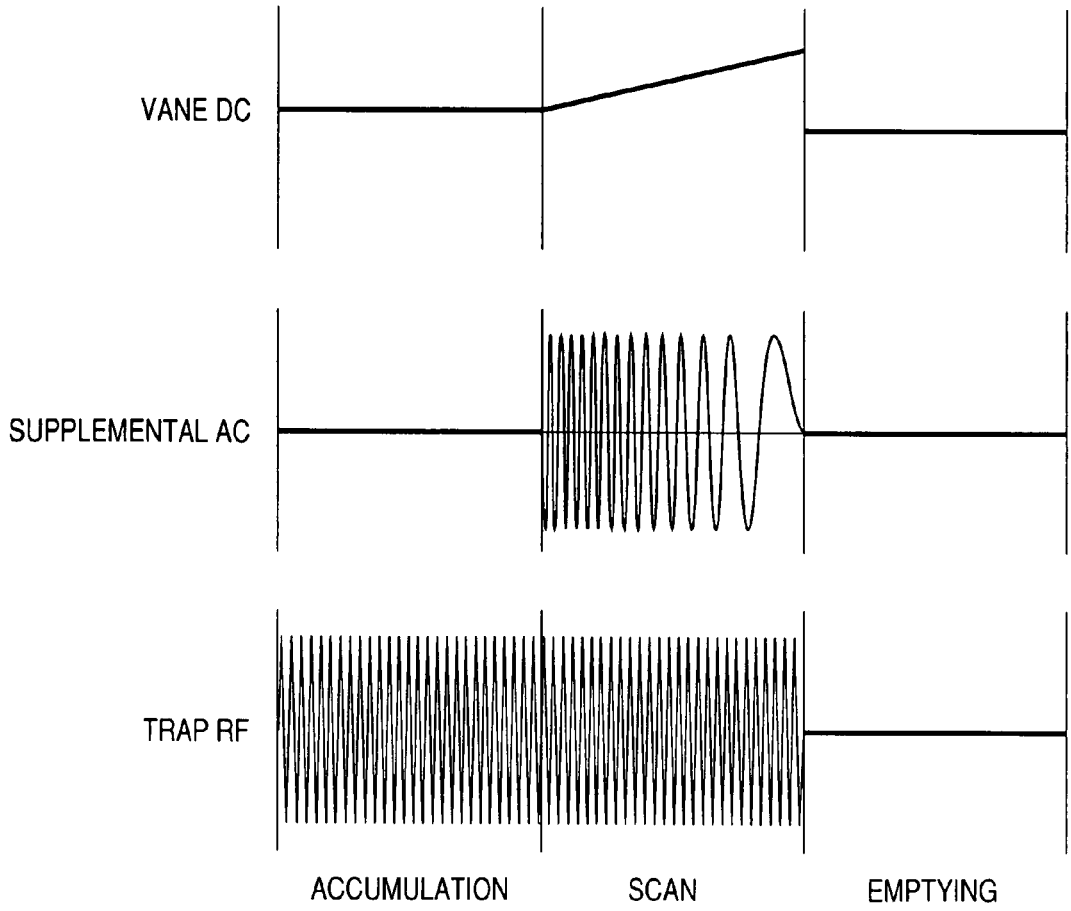
FIG. 11 is a graph showing the sequence measurement during the linear trap operation in the fourth embodiment.

FIG. 11 shows the measurement sequence of the fourth embodiment. Measurement is performed in three sequences. A trap RF voltage (amplitude 100 volts-5,000 volts, frequency 500 kHz-2 MHz) was applied to the quadrupole rod lens 10 during the trap period. A direct current (DC) voltage of 10 to 100 volts is applied to the vane lens 50. Typical voltages applied to the other lenses are: setting the inlet lens 11 from 5 to 20 volts and the exit lens 12 from 10 to 100 volts. The trap RF voltage forms a pseudo-potential along the radial direction of the quadrupole rod lenses, and a DC bias between the quadrupole rod lens 10 and the vane lens 50 forms a pseudoharmonic potential along the center axis of the quadrupole field. The supplied ions in this fourth embodiment are therefore trapped in the region 100 enclosed by the vane lens 50 and the quadrupole rod lens 10.

Next, a supplemental AC voltage (amplitude 0.01 volts-1 volt, frequency 10 kHz-500 kHz) was applied to the vane lens 50, in addition to the DC voltage (20-300 volts) during the mass scan period. The supplemental AC voltage phase is set to the same phase across the opposing and adjoining vane lenses ((50*a*, 50*b*, 50*c*, 50*d*) and (50*e*, 50*f*, 50*g*, 50*h*) in the figure) along the radial direction; but is set to the opposite phase across the opposing vane lenses ((50*a*, 50*e*) (50*b*, 50*f*), (50*c*, 50*g*) and (50*d*, 50*h*) in the figure) along the axis. Typical voltages applied to the other lenses are the exit lens 12 which is set from 0 to 10 volts, the inlet lens 12 which is set from 10 to 100 volts. Ions are selectively excited according to mass by the supplemental AC voltage are ejected along the axis. FIG. 10 shows a concept view of the trajectory 101 of the ejected ions at this time. The supplemental AC frequency can be scanned from high (300-500 kHz) to low (10-50 kHz) or from low to high to obtain the mass spectrum. The mass scan period length is from approximately 10 ms to 200 ms, and is largely proportional to the range of the mass for detection.

Lastly, all voltages are set to 0 during the ejection period, and the ions are all ejected outside the trap. The length of the ejection period is approximately 1 ms.

The case when operating the spectrometer as a quadrupole mass filter is described next. The device structure up to the ions arriving at the mass analyzer unit and the device structure from the mass analysis unit onward is the same as the linear trap operation so a description is omitted here. During operation as a quadrupole mass filter, buffer gas is not supplied to the mass analyzer unit 7 which is maintained at $10^{-5}$ Torr-$10^{-4}$ Torr ($1.3\times10^{-3}$ Pa–$1.3\times10^{-2}$ Pa). The vane lens 50 is set to 0 volts during operation as a quadrupole mass filter. Voltages applied to other lenses are the same as the first embodiment so their description is omitted here.

Compared to the first, second and third embodiments, when operated as a linear trap, the fourth embodiment is capable of ejecting ions regardless of the trap RF voltage so is advantageous for inducing ion molecular reactions or MS/MS analysis. Moreover, the ion ejection efficiency is high since the direction the ions are excited matches the direction that the ions are ejected. On the other hand, the lens (electrode) shape is complicated compared to the first and second embodiments. Also the trap potential along the axis is the static (DC) pseudoharmonic potential so that the spatial distribution of the ions is narrow along the axis compared to the first and the second embodiment and spatial charges tend to occur.

Fifth Embodiment

Figure 12:
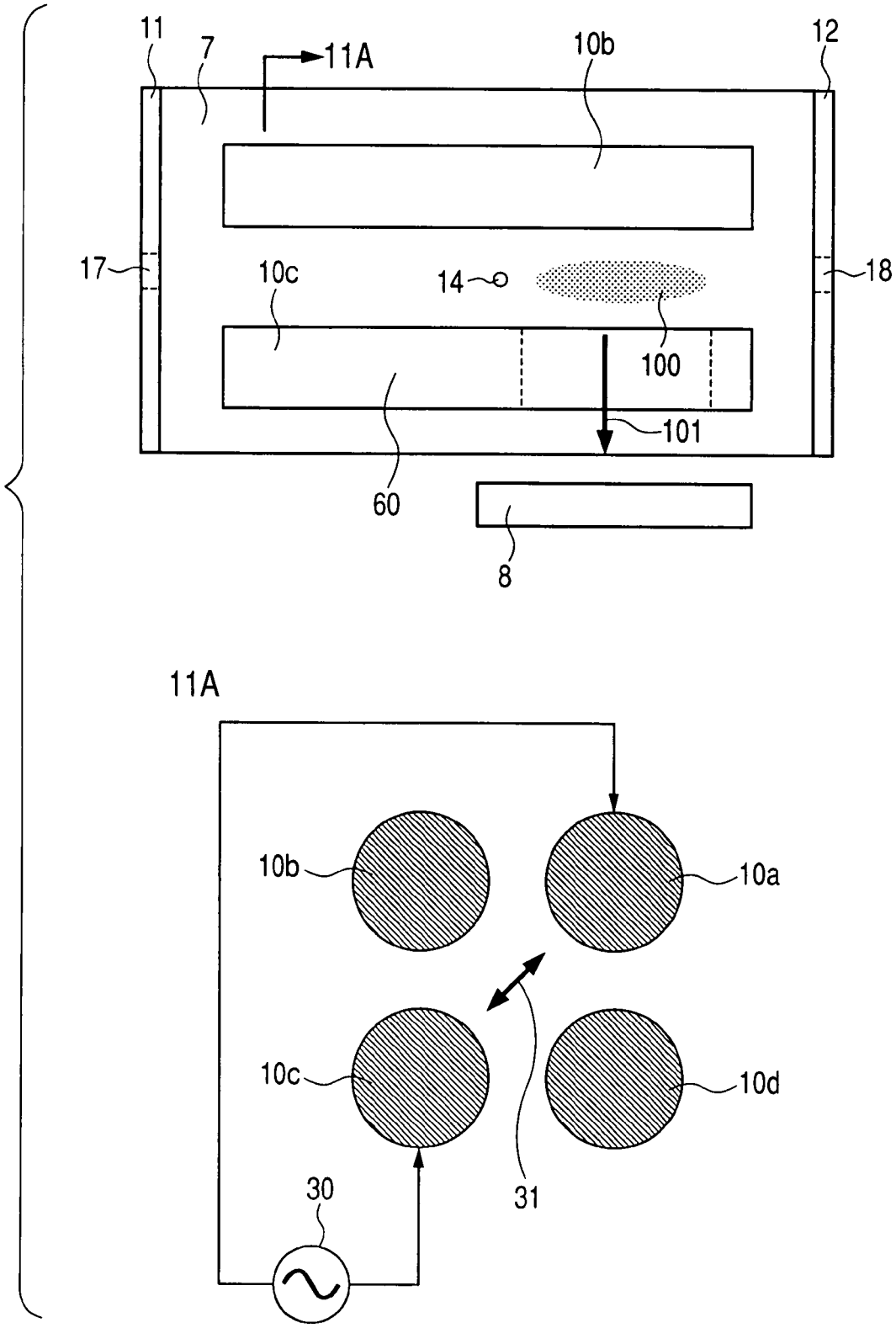
FIG. 12 is a diagram of the mass spectrometer of the fifth embodiment and the cross sectional view.

FIG. 12 is a structural diagram of the mass spectrometer of this method. FIG. 12A is a cross sectional view. The device structure up to the ions arriving at the mass analyzer unit and the device structure from the mass analysis unit onward is the same as the first embodiment so a description is omitted here.

First of all, operating the spectrometer as a linear trap is described. During operation as a linear trap, buffer gas is supplied to the mass analyzer unit 7 and maintained at $10^{-4}$ Torr-$10^{-2}$ Torr ($1.3\times10^{-2}$ Pa–1.3 Pa). The trap lens 14 may utilize a thin-plated lens (electrode) or a wire-shaped lens (electrode). The wire-shaped lens possesses lower ion transmittance loss but the lens shape is more difficult to manufacture.

Figure 13:
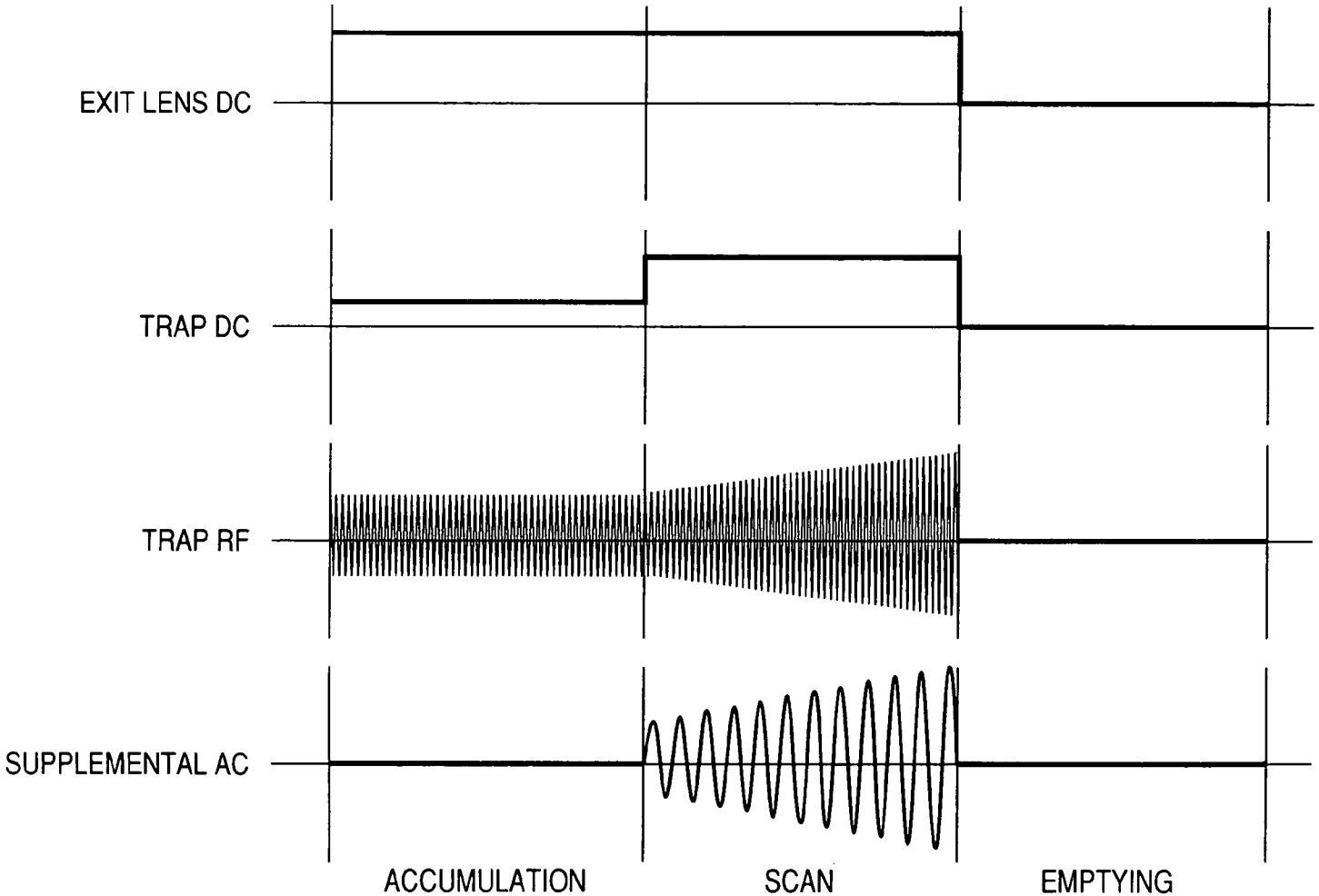
FIG. 13 is a graph showing sequence measurement during linear trap operation in the fifth embodiment.

FIG. 13 shows the measurement sequence of the fifth embodiment. Measurement was performed in three sequences. A trap RF voltage (amplitude 100 volts-5,000 volts, frequency 500 kHz-2 MHz) was applied to the quadrupole rod lens 10 during the trap period. Typical voltages applied to the other lenses are: setting the trap lens 14 from 5 to 20 volts and the exit lens 12 from 10 to 50 volts. The trap RF voltage forms a pseudo-potential along the radial direction of the quadrupole lens, and DC voltage on outlet 12 and the trap lens 14 forms DC along the center axis of the quadrupole field. The supplied ions in this fifth embodiment are therefore trapped in the region 100 enclosed by the trap lens 14, the quadrupole rod lens 10 and the exit lens 12.

Next, during the mass scan period, a supplemental AC voltage (amplitude 5 volts to 100 volt, frequency 10 kHz-500 kHz) is applied between the pair of opposing quadrupole rod lenses. Typical voltages applied to the other lenses are; setting the trap lens 14 from 10 to 50 volts, and the exit lens 12 from 5 to 50 volts. Ions excited along the radial direction by the supplemental AC voltage are ejected along the radial direction via the slot 60 formed in the quadrupole rod lens 10. FIG. 12 shows a concept view of the trajectory 101 of the ejected ions at this time. The trap RF voltage amplitude can be scanned from low (100-1,000 volts) to high (500-5,000 volts) to obtain the mass spectrum. The mass scan period length is from approximately 10 ms to 200 ms, and is largely proportional to the range of the mass for detection. Finally, all voltages are set to 0 during the ejection period, and the ions are all ejected outside the trap. The length of the ejection period is approximately 1 ms.

The case when operating the spectrometer as a quadrupole mass filter is described next. The device structure up to the ions arriving at the mass analyzer unit and the device structure from the mass analysis unit onward is the same as the linear trap operation so a description is omitted here. During operation as a quadrupole mass filter, buffer gas is not supplied to the mass analyzer unit 7 which is maintained at $10^{-5}$ Torr-$10^{-4}$ Torr ($1.3\times10^{-3}$ Pa–$1.3\times10^{-2}$ Pa). The trap lens 14 is set to 0 volts during operation as a quadrupole mass filter. Voltages applied to the other lenses are the same as the first embodiment so their description is omitted here.

Compared to the first and fourth embodiments, there are fewer lenses (electrodes) so the fifth embodiment has the advantage of a low cost. Also, the ion ejection speed is high since the ions are resonance-excited radially and ejected in radial direction. However, the voltage applied to the quadruple rod is on the order of kilovolts during resonance-ejection of the ions so the distribution of the ejection energy reaches several 100 eV or more. The fifth embodiment also has the problem that the power supply for applying voltage to the quadrupole rod lens is complicated.

Sixth Embodiment

Figure 14:
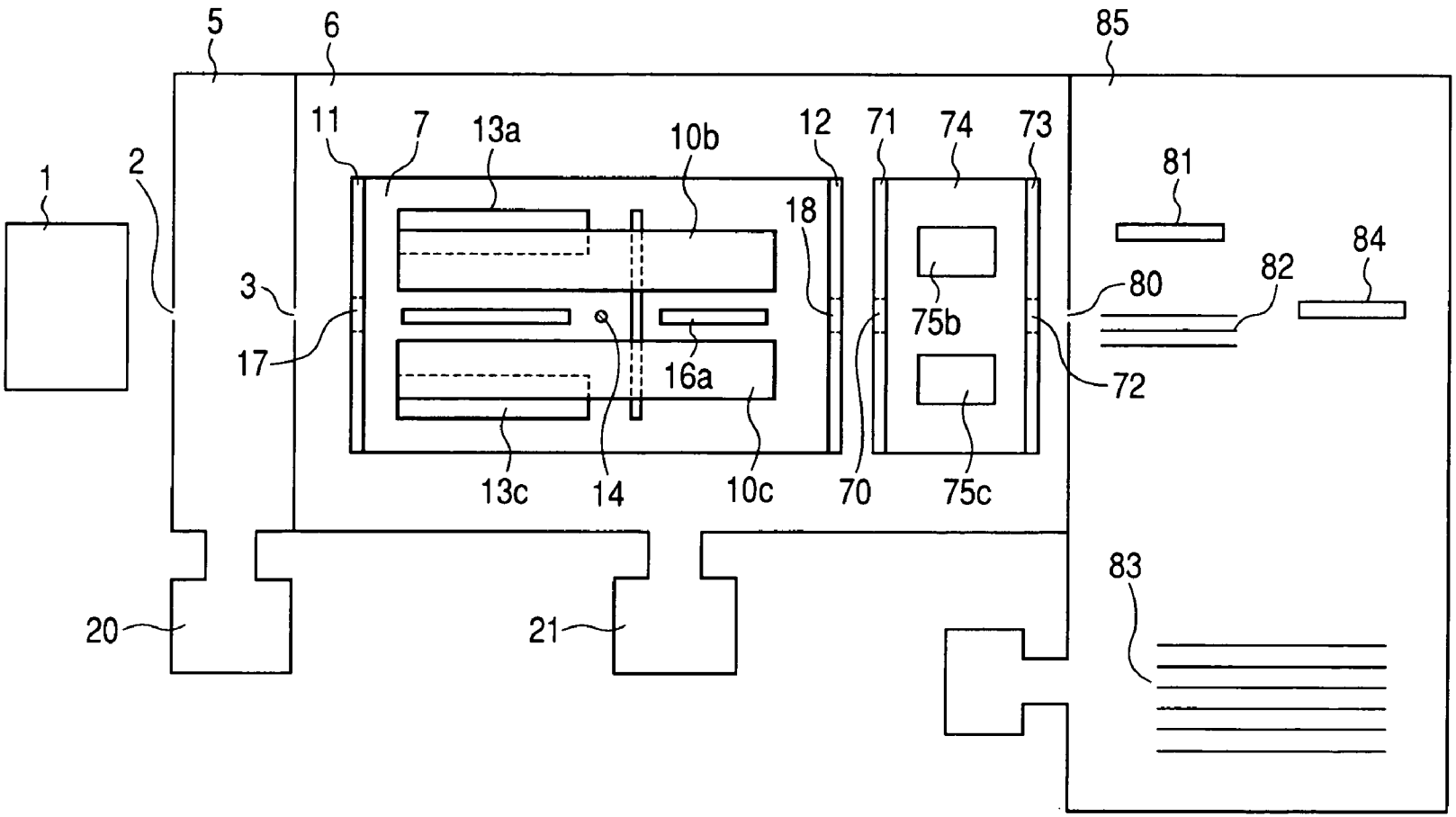
FIG. 14 is a diagram of the structure of the mass spectrometer of the sixth embodiment.

FIG. 14 is a diagram of the mass spectrometer of the method for this invention. The process up to the ions arriving at the mass analyzer unit from the ion source and the process for ejecting ions selectively by mass from the mass analysis unit 7 is the same as the first embodiment so a description is omitted here.

In the sixth embodiment, ions selectively ejected from the mass analysis unit 7 according to mass are supplied to a collisional dissociation portion 74. The mass analysis unit 7 may at this time be operated as a linear trap or as a quadrupole mass filter. When performing MS/MS analysis, the ion usage efficiency of the sixth embodiment becomes high when operated as quadrupole mass filter to consecutively pass the designated ions.

The collisional dissociation portion 74 includes an input lens 71, a multipole rod lens 75, an exit lens 73, and gas such as nitrogen or argon gas is supplied into the interior at a pressure of approximately 1 m Torr-30 mTorr (0.13 Pa-4 Pa). Ions introduced from the aperture 70 are disassociated in the collisional dissociation portion. The collisional dissociation is made to progress efficiently at this time by setting the voltage differential between the offset voltage of quadrupole rod lens 10 and the offset voltage of multipole rod lens 75 between approximately 20 to 100 volts.

Fragmented ions generated by the dissociation pass through the aperture 72 and the aperture 80, and are supplied into the time of flight mass analyzer portion. A pump 22 exhausts (evacuates) the time of flight mass analyzer portion and maintains it at $10^{-6}$ Torr or less ($1.3\times10^{-4}$ Pa or less).

In the example in this embodiment, the collisional dissociation chamber was made up of four rod-shaped lenses, however the number of rod lenses may be 6, 8, 10 or more. Many lens-shaped electrodes may be installed and the structure may applying RF voltage of different phases to each (lens-shaped) electrodes. Any structure capable of being utilized as the collisional dissociation portion may be applied in the same way to the present invention.

Ions supplied to the time of flight mass analyzer portion are periodically accelerated in a cross direction by the pusher 81, and after being accelerated by the throw out grid 82, are reflected from the reflectron 83 and detected by a detector 84 made up of an MCP (microchannel plate) etc. The m/z can be determined by the time from pusher acceleration until detection, and the ion intensity from the signal strength so that a mass spectrum of fragment ions can be obtained. These fragment ions are fragment of precursor ions with a designated m/z ejected from the linear trap, and therefore the ion mass ejected from the ion trap is the primary side, the ion mass detected by the time of flight mass analyzer portion is the secondary side, and the signal strength is the three-dimensional side so that a three-dimensional mass spectrum can be obtained. Information from the precursor ion scan and neutral loss scan can also be acquired from this type of information.

Besides this collisional dissociation, a magnetic field can be applied to this section to allow electron capture dissociation if electrons are input. Irradiating laser light can be also introduced to achieve photo dissociation.

A common element in the first through the fifth embodiments is that the exit lens or the inlet lens can be a mesh electrode, and the trap lens and extraction lens may be a lens shape (thin plate shape) other than a wire shape. Moreover, in the example described in the embodiments the rod lens was described as a quadrupole lens, however other multipole lens may also be utilized. Further, more than one from among the trap RF frequency and its amplitude, the supplemental resonance voltage frequency and multiple voltage amplitude may also be changed as the mass scanning method.

What is claimed is:

1. A mass spectrometer comprising:

an ion trap including a set of multipole rod lenses, an exit lens and an inlet lens supplied with ionized ions and, a second lens installed intermediate of the multipole rod lenses radially between one end and the other end of the set of multipole rod lenses, for controlling the supplied ions and, a controller unit for controlling the voltage applied to the lenses and, a mass analyzer unit or a detector for detecting ions ejected from the ion trap, wherein the controller unit switches between an operation to trap the supplied ions in a section of the set of multipole rod lenses and eject the ions mass selectively; and to operation as a mass filter by controlling the voltage on the second lens.

2. The mass spectrometer according to claim 1, wherein the controller unit traps the supplied ions between the second lens and one end of the multipole rod lenses by controlling the voltage on the second lens.

3. The mass spectrometer according to claim 1, wherein the controller unit traps the supplied ions between the second lens and the output lens by controlling the voltage on the exit lens and the second lens.

4. The mass spectrometer according to claim 1, wherein the controller unit selectively passes the supplied ions according to mass by exerting control to eliminate the voltage differential between the multipole rod lenses and the second lens.

5. The mass spectrometer according to claim 1, wherein the controller unit acquires the mass spectrum on the detector by changing the size of the voltage applied to the multipole rod lenses.

6. The mass spectrometer according to claim 1, wherein the second lens is shaped as a thin plate or a wire, installed facing along the radial direction between the adjoining multipole rod lenses.

7. The mass spectrometer according to claim 1, comprising a vane lens installed between adjacent rods of the quadrupole rod lens, and positioned between either one end of the multipole rod lenses and the second lens, or between the second lens and the other end of the multipole rod lenses, wherein the controller unit applies a supplemental AC voltage to the vane lens.

8. The mass spectrometer according to claim 7, wherein the controller unit traps the supplied ions in a section enclosed by the multipole rod lenses and the vane lens by controlling the voltage applied to the vane lens.

9. The mass spectrometer according to claim 1, further comprising a disassociation section between the mass analyzer and the ion trap, for separating the ejected ions from the ion trap.

10. The mass spectrometer according to claim 1, wherein the controller unit for regulating a gas supplied to the ion trap, executes control to supply gas during the operation for trapping the supplied ions in a section of the multipole rod lens, and for not supplying gas during the operation to selectively pass the ions according to mass.

11. A mass spectrometry method for supplying ions generated by an ion source and controlling the ions during ion trapping, and including a set of multipole rod lenses applied with a radio frequency voltage, wherein the mass spectrometry method uses a second lens installed intermediate of the multipole rod lenses radially between one end and the other end of the set of multipole rod lenses, the method comprising:

1) trapping and oscillating the supplied ions in a section of the set of multipole rod lenses and ejecting the oscillated ions along the center axis of the set of multipole rod lenses by regulating the voltage on the second lens; and 2) switching the supplied ions to a process for filtering the ions according to mass, and analyzing the ejected or filtered ions in an analyzer unit.

12. The mass spectrometry method according to claim 11, further comprising:

oscillating a portion of the ions supplied into the ion trap by applying an alternating current voltage to a vane lens inserted between the multipole rod lenses in the process 1).

13. The mass spectrometry method according to claim 11, further comprising:

oscillating a portion of the ions supplied into the ion trap by applying an alternating current voltage to the multipole rod lenses in the process 1).

14. The mass spectrometry method according to claim 11, further comprising:

selectively passing the supplied ions according to mass, by controlling the voltage differential between the multipole rod lenses and the second lens in the process 2).

15. The mass spectrometry method according to claim 11, further comprising:

acquiring the mass spectrum by changing the size of the voltage on the multipole rod lenses in the process 2).

16. The mass spectrometry method according to claim 11, wherein the analysis process includes a process for disassociating the ejected or filtered ions and, a process for mass-disassociating and detecting the disassociated ions.

17. The mass spectrometry method according to claim 11, wherein the method uses supplying buffer gas to the ion trap in the process 1), and does not use supplying buffer gas to the ion trap in the process 2).

18. An ion trap operating method for supplying ions generated by an ion source and controlling the ions during ion trapping, and including a set of multipole rod lenses applied with a radio frequency voltage, wherein the mass spectrometry method uses a second lens installed intermediate of the multipole rod lenses radially between one end and the other end of the set of multipole rod lenses, the method comprising:

1) trapping and oscillating the supplied ions in a section of the set of multipole rod lenses and ejecting the oscillated ions mass selectively along the center axis of the multipole rod lens by controlling the voltage on the second lens; and 2) performing an operation to switch to a process for filtering the supplied ions according to mass by executing control to eliminate the voltage differential between the multipole rod lens and the second lens.

* * * * *